US005240245A

United States Patent [19]

Ademmer et al.

[11] Patent Number: 5,240,245

[45] Date of Patent: Aug. 31, 1993

[54] CONTAINER FOR RECEIVING BANK NOTES IN A BANK NOTE DISPENSING DEVICE

[75] Inventors: Heinz Ademmer, Geseke; Gunter Holland-Letz, Paderborn; Peter Weigel, Borchen-Dorenhagen, all of Fed. Rep. of Germany

[73] Assignee: Siemens Nixdorf Informationssysteme A.G., Paderborn, Fed. Rep. of Germany

[21] Appl. No.: 776,430

[22] PCT Filed: Jan. 15, 1991

[86] PCT No.: PCT/EP91/00057

§ 371 Date: Dec. 4, 1991

§ 102(e) Date: Dec. 4, 1991

[87] PCT Pub. No.: WO91/14999

PCT Pub. Date: Oct. 3, 1991

[30] Foreign Application Priority Data

Mar. 20, 1990 [DE] Fed. Rep. of Germany ..... 4008973

[51] Int. Cl.[5] ..... B65H 29/00

[52] U.S. Cl. ..... 271/279; 271/213; 271/220; 271/295

[58] Field of Search ..... 271/213, 279, 294, 295, 271/220

[56] References Cited

U.S. PATENT DOCUMENTS 4,398,712 8/1983 George ..... 271/295 X
5,037,081 8/1991 Engelhardt et al. ..... 271/213 X

*Primary Examiner*—Robert P. Olszewski
*Assistant Examiner*—Boris Milef

[57] ABSTRACT

A container (10) for receiving bank notes in a bank note dispensing device has a closable housing (12) with an intake opening (20) for the bank notes. Two driven, cooperating draw-in rollers (22,24) in the region of or in the intake opening (20) delimit a draw-in gap (26) through which bank notes are drawn in. The device comprises a plurality of compartments (I to V, 48) for receiving bank notes. The receiving openings of the compartments (I to V, 48) can be optionally connected to the draw-in gap (26).

9 Claims, 5 Drawing Sheets

CONTAINER FOR RECEIVING BANK NOTES IN A BANK NOTE DISPENSING DEVICE

Figure 1:
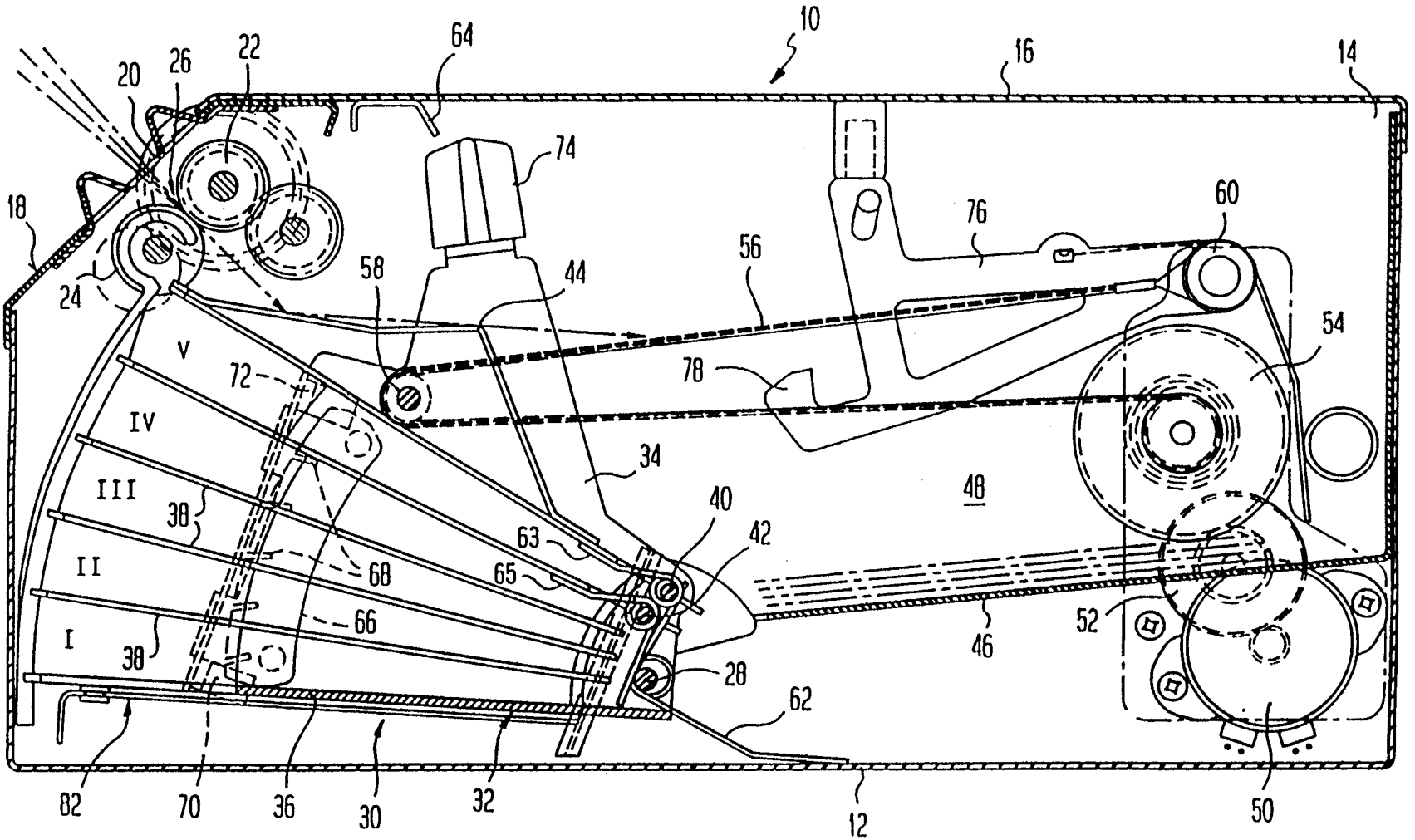

The invention relates to a container for receiving bank notes in a bank note dispensing device with a closable housing, which container has an inlet opening for the bank notes, with two cooperating driven rollers arranged in or near the inlet opening defining a draw-in gap for the drawing in of bank notes.

In bank note dispensing devices containers are as a rule provided which have the purpose of receiving individual bank notes, or bundles of the same, which because of some error function or disturbance in the bank note dispensing device should not be or cannot be dispensed to the customers. These bank notes were formerly not separately collected in the customary containers, referred to as reject-cassettes.

In practice cases have now appeared in which for example a bank note bundle has been correctly assembled and placed at the disposable of the customer so that the customer was able to remove the bank note bundle, but the bundle was not removed or not completely removed. In such case it is necessary that the bank notes made available but not taken, after the lapse of a pre-given time span, are again drawn into the machine. If they are then transferred to the customer reject-cassette they can no longer by associated with an individual customer. It therefore becomes no longer determinable whether the customer actually has or has not taken all of the bank notes made available to him.

The invention has as its object the provision of a container of the previously mentioned type which makes it possible to take back bank notes so that they can be associated with a given transaction.

This object is solved in accordance with the invention in that the container includes a plurality of compartments for receiving bank notes and in that the openings of the compartments are selectively connectable with the draw-in gap.

One of the compartments can therefore be designated to receive all of those bank notes for which an association with a given transaction is not necessary. The remaining compartments can then be used to receive bank notes which later have to be associated with given transactions. Since the number of such transactions occurring inside of 24 hours is as a rule limited, a limited number of compartments is sufficient.

Preferably one of the compartments is formed by a section of the housing, while the remaining compartments are formed by compartment walls parallel to the draw-in gap and separated from one another in a frame, which frame is pivotally supported for movement about a pivot axis parallel to the draw-in gap, that the receiving openings of the compartments can be sequentially brought into alignment with the draw-in gap by pivoting of the frame. All bank notes which need not be associated with a given transaction are conducted to the housing section. The bank notes or bank note bundles for which an identification is to be made, are in contrast delivered to the compartments formed by the pivotal frame, with a corresponding compartment being brought into alignment with the draw-in gap before the drawing in of the bank notes or bank note bundles. The compartment number is associated with the transaction, so that the contents of the compartment can later be transmitted or credited to the customer.

To assure a trouble-free entry of the bank notes or bank note bundles into the associated compartments it is desirable if tongues are formed on the edge of each compartment wall facing the draw-in gap, which tongues are receivable in complementary circumferential grooves in one of the draw-in rollers. Thereby a gapless transfer of the bank notes from the draw-in gap to the assigned compartment is made. So that the bank notes cannot hang up on the edges lying between the tongues it is desirable if these edge sections are inclined relative to the direction of the draw-in gap.

If the bank notes are to be conducted to the general receiving compartment, that is to the housing section, this can occur in a simple way if the frame is pivoted out of the path of the draw-in gap with the pivotal frame on an outer side being provided with a deflector which in this end position of the frame conducts the pulled in bank notes from the draw-in gap directly to the housing section. A special transport mechanism is therefore not necessary.

The adjustment of the frame can be performed by a stepping motor, with the return positioning being effected by a spring. To permit identification of the involved compartment, sensing elements are provided for determining the momentary position of the frame, with the frame possibly carrying code markings or only counting markers, which are sensed upon shifting of the frame.

To achieve the best space saving arrangement, at least a portion of the compartment walls can be supported on the frame for movement about axes parallel to the pivot axis of the frame. In this way it is possible to collapse the compartments flatly so long as they are not needed. Further details are explained hereinafter in the following description.

With customary reject-cassettes the removal of the received bank notes is simple when the cover of the cassette is open. To achieve a simple removal of the bank notes stored in the compartments in the case of the inventive solution, in accordance with an especially preferred embodiment of the invention the frame is pivotable to a removal position in which the receiving openings of the compartment are accessible through the opening of the housing.

Since the compartments are in general relatively small and yet deep, in accordance with the invention a slide is supported on the frame for shifting movement parallel to the removal direction of the bank notes, which slide by means of an arm passing through parallel slots in the compartment walls serves to support the bank notes deposited in the compartments. By a shifting of the slide in the removal direction the bank notes are lifted relative to their compartments so that they can be easily grasped and removed.

The following description explains the invention in association with the accompanying drawings with respect to an exemplary embodiment. The drawings are:

FIG. 1—A schematic longitudinal sectional view through a reject-cassette embodying the invention with an individual compartment receiving frame in the position in which bank notes inserted through the draw-in gap are conducted to the general collecting compartment.

Figure 2:
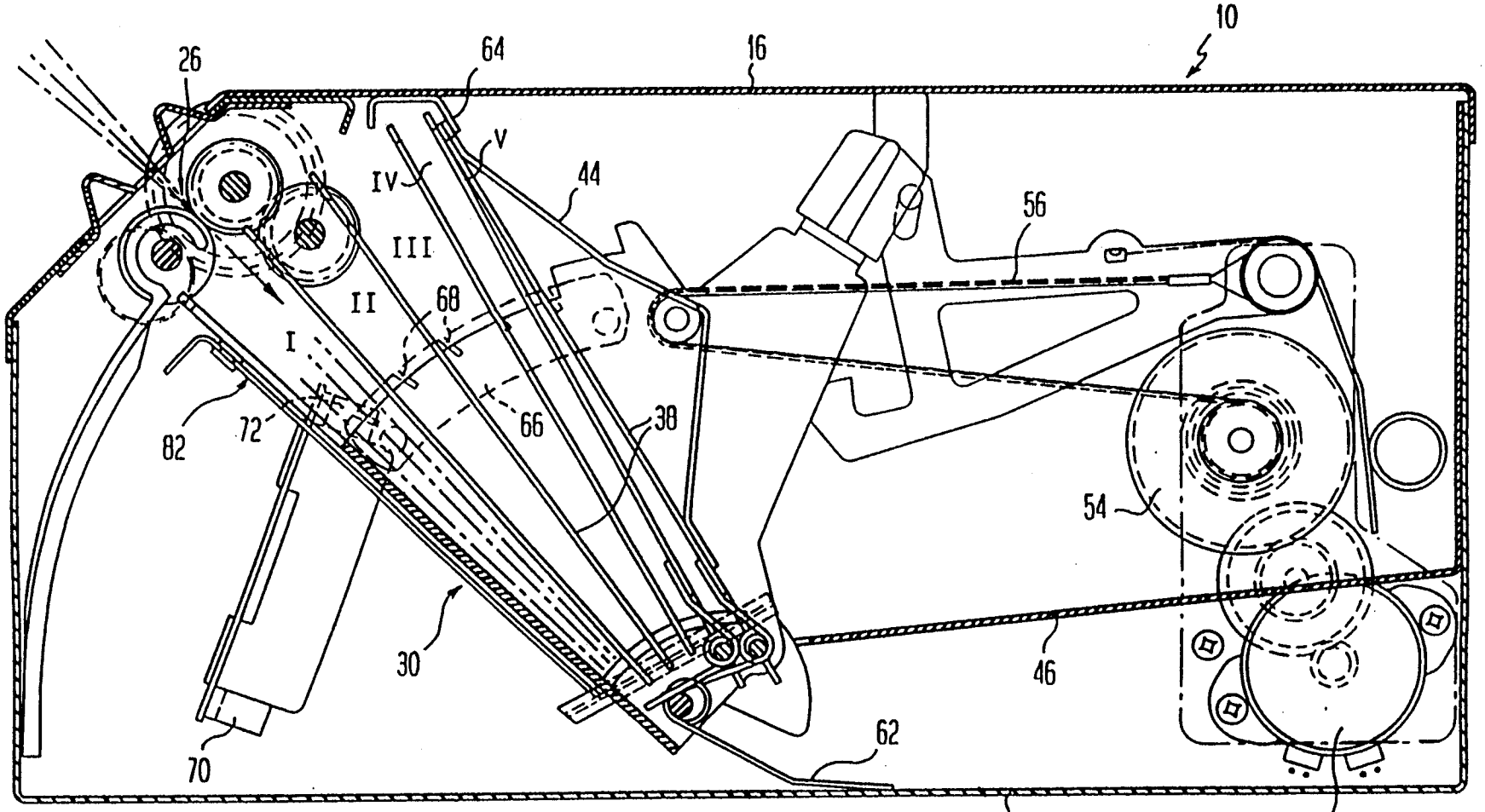

FIG. 2—A view corresponding to FIG. 1 with the frame in a position in which the first compartment of the frame is being filled.

Figure 3:
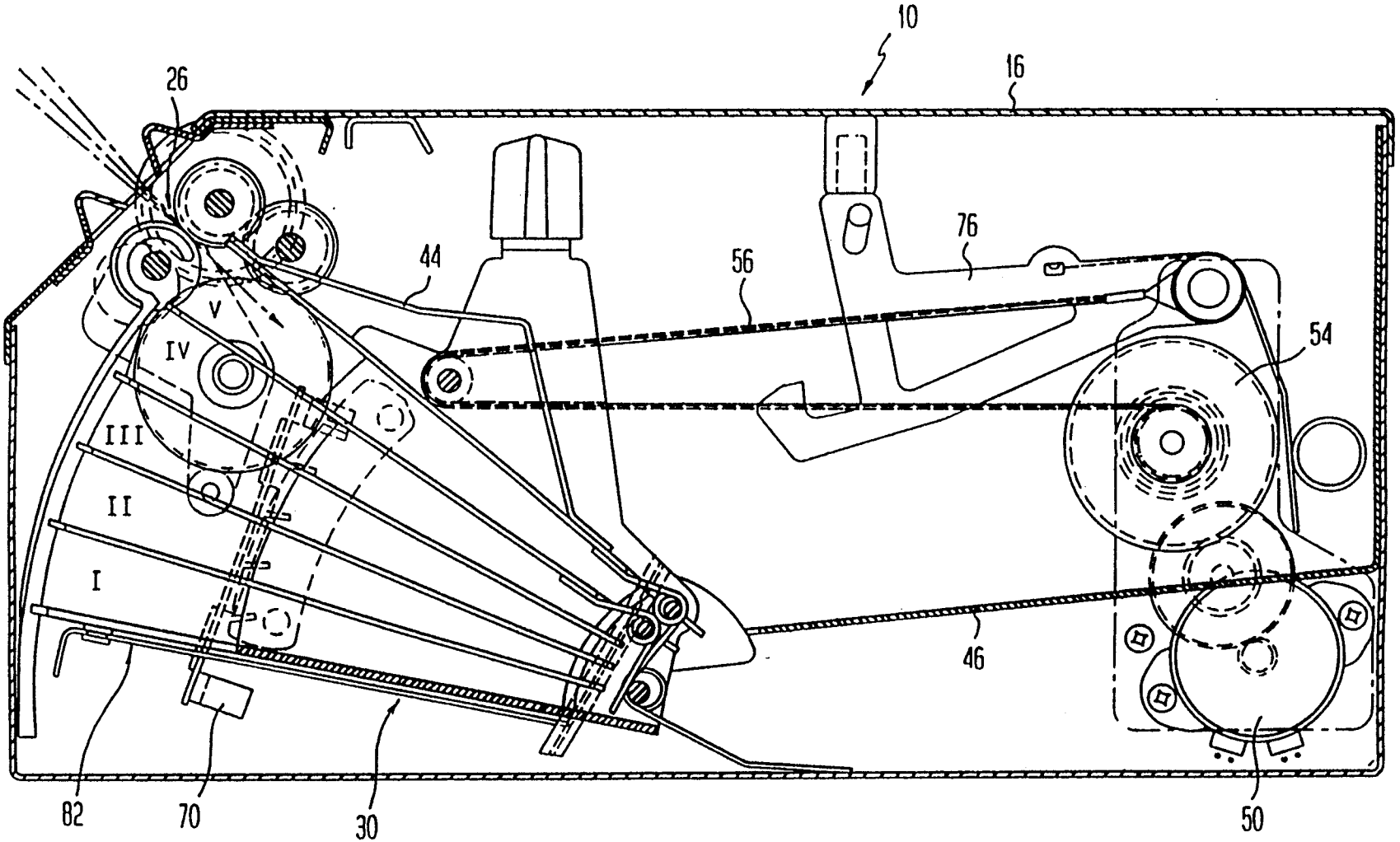

FIG. 3—A view corresponding to FIG. 1 with the frame in a position in which the last compartment of the frame is being filled.

Figure 4:
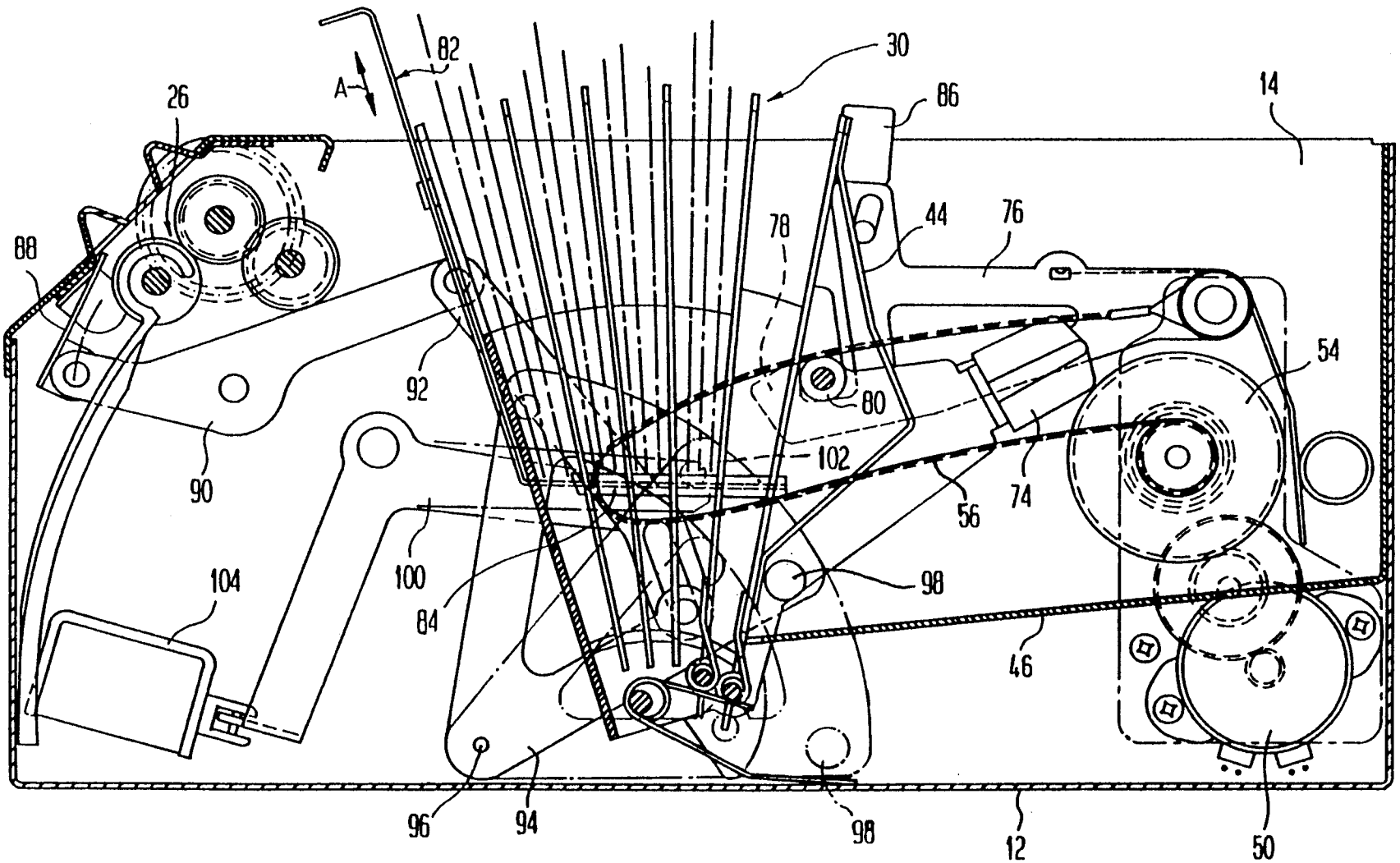

FIG. 4—A view corresponding to FIG. 1 with the cassette in an open condition and with the frame in its removal position.

Figure 5:
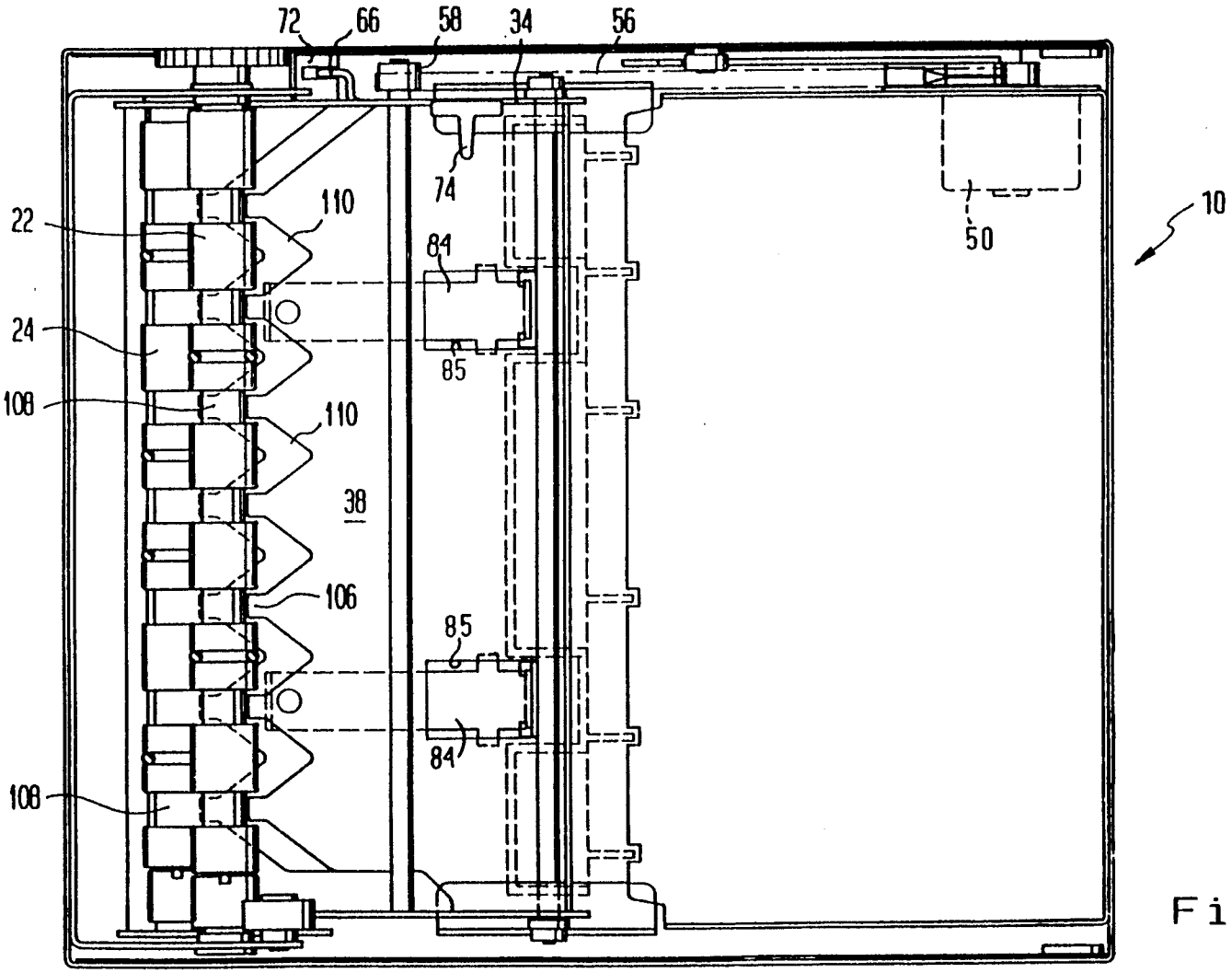

FIG. 5—A schematic plan view of the forward end of the cassette.

The reject device indicated generally in FIG. 1 by the reference numeral 10 includes a generally rectangular housing 12 with an opening 14, which is closed by a cover 16. The manipulation secure mechanism for locking the cover 16 to the housing 12 is itself known and need not be described here in further detail.

At its forward upper corner the container 12 is inclined. In the inclined surface 18 is a slot-shaped inlet opening 20, at which a transport path for bank notes ends when the reject-cassette is inserted into a money dispensing machine. Inside the housing 12 are two draw-in rollers 22 and 24 which are located close to the inlet opening 20 and so supported parallel to the longitudinal direction of the inlet opening 20 that they together define a draw-in gap 26. The draw-in rollers are driven by a non-illustrated drive. The draw-in roller 24 is shiftable perpendicularly to its axis so that not only individual bank notes but also bundles of bank notes can be pulled in through the draw-in gap. The cassette as so far described is in itself known.

In the forward half of the housing 12 a compartmented store, indicated generally at 30, is supported for pivotal movement about an axis 28 parallel to the draw-in gap 26. The compartmented store includes a frame 32 with two side walls 34 perpendicular to the axis 28 and a rear wall 36 connected to the side walls, as well as a plurality of compartment walls 38. The compartment walls and the rear wall 32 together define five compartments intended for the reception of bank notes. The two of the compartment walls 38 spaced furtherest from the rear wall 36 are pivotally supported for movement relative to the side walls 34 about axes 40,42 parallel to the axis 28. The reason for this is explained further in connection with FIG. 2. On the outer wall of the outermost compartment wall 38 is fastened a deflector 44, which serves to deflect bank notes pulled in through the draw-in gap 26 in the way illustrated in FIG. 1 so that they fall onto a support surface 46 of a collecting compartment, indicated generally at 48, in the housing 12. All bank notes are collected here which do not have to be associated with a given transaction.

If on the other hand individual bank notes or bank note bundles are to be associated with a given transaction of the money dispensing machine, so that the money can be later dispensed to a customer or credited to him, these bank notes are not given to the general collecting compartment 48, but instead are put aside in one of the compartments of the compartmented store 30 indicated by the roman numbers I–V. For this the compartmented store 30 is first pivoted about its axis 28 to the position illustrated in FIG. 2. A drive mechanism serves to perform this pivoting with drive mechanism having a step motor 50 which through a drive 52 drives a belt pulley 54 onto which a tension belt 56 is windable. The tension belt 56 runs over a deflecting roller 58 supported by the side walls 34 of the frame 32 and from this roller extends back to an anchoring element 60 fastened to the housing. The pivoting of the compartmented store 30 by the stepping motor 50 takes place against the force of a return spring 62, which biases the compartmented store 30 to the position illustrated in FIG. 1.

As can be seen in FIG. 2 the housing 12 is too flat to bring the compartmented store 30 in its FIG. 1 size to the position illustrated in FIG. 2. By means of the pivotal arrangement of the compartment walls 38 remote from the rear wall 36 these pivotal walls upon engaging an angle bracket 64, fastened to the inner side of the cover 16, are so pivoted against the bias of springs 63,65, that compartments IV and V are practically collapsed. Because of this it is however necessary that the compartments of the compartmented store 30 be filled in the sequence given by their roman numbers, since the compartmented store 30 can no longer be pivoted far enough after filling compartment V to still fill compartment I.

A segment 66 is rigidly connected with the frame 32, which segment has slots 68 associated with compartments I to V. This segment 66 upon pivoting of the frame 32 is moved between two forked light boxes 70 and 72 which upon passage of the slits 68 deliver counting pulses. In this way the position of the compartmented store can be determined.

FIG. 3 shows a filling of the last compartment V of the otherwise already filled compartmented store 30. It is to be emphasized here that the compartmented store 30 after the filling of some of the compartments I to V naturally can be returned its beginning position as shown in FIG. 1, so that the path to the general collecting compartment 48 is free since the cases in which a given bank note bundle must be associated with a given transaction of the dispensing machine are relatively rare.

FIG. 4 shows the removal of the bank notes stored in compartments I to V after the opening of the container 10. The cover 16 is removed. The compartmented store 30, with the help of a hand grip 74 fastened to one of the side walls 34, has been shifted so far against the tension of the spring 62 to the point at which it takes the upright position illustrated in FIG. 4, in which position a bolt 76 pivotal in one of the housing side walls catches with its bolt nose 78 a pin 80 connected with the side wall 34.

A slide indicated generally at 82 is so moveably supported on the rear wall 36 that it can be slid back and forth in the direction of the double arrow A of FIG. 4. The slide 82 has two telescopically elongatable arms 84 each which passes through slots 85 in the compartment walls 38, so that the slide together with the arms 84 can be shifted between the positions illustrated in FIGS. 1 to 3 and the position illustrated in FIG. 4. The bank notes deposited in the compartments I to V lie on the arms 84 of the slide 82 and can upon elevation of the slide 82 be lifted from the compartments I to V. Thereupon they can be easily grasped and taken out of the compartments. By pressing on the part 86 the bolt 76 can be returned and the compartmented store be made free.

When the reject-cassette of the money dispensing machine is removed all openings of the cassette 10 should be closed. The main opening is closed by the cover 10 which only is locked with special means. In order however to prevent manipulation at the inlet opening, a slide 88 is arranged at the inlet opening which inside the housing 12 is fastened to a pivotal lever 90 and by pivoting of the same is pushed in front of the mushroom-shaped inlet opening 20. The lever 90 is connected to a drive lever 94 through a double link 92, which drive lever is supported for movement relative to the housing side wall about an axis 96 and which extends with a pin 98 through an arc-shaped curved slot in the housing wall. This pin 98 can extend into a non-illustrated sliding guide of the push in frame, in which the reject-cassette can be inserted. Therefore by means of these sliding guides the drive lever 94 is shifted from its dashed line illustrated position, in which the inlet opening 20 is closed by the slide 88, to its once again open position illustrated by the solid lines. This is moreover only possible if the drive lever 94 has been unlocked. The drive lever 94 is locked in its dashed line closed position by a latch lever 100, which latches behind a pin 102 fastened to the drive lever and which can be pivoted to its freeing position by an electromagnet 104. The electromagnet 104 is then only actuated when after the input of a correct password a corresponding control signal is generated.

In FIG. 5 is shown a detail of the draw-in rollers 22,24 and of the compartment walls 38 which assure a frictionless transfer of bank notes from the draw-in gap 26 to the compartments I to V. In connection with this, rectangular tongues 106 are formed on the edge portions of the compartment walls 38 facing the draw-in rollers 22,24, which tongues are received in complementary annular grooves 108 in the draw-in rollers. The edges of the open areas 110 lying between the tongues 106 are inclined to form a swept back shape to avoid the edges of the bank notes from hanging to them.

We claim:

1. A container for receiving bank notes in a bank note dispensing device with a closable housing (12), having an inlet opening (20) for the bank notes, with two cooperating drivable draw-in rollers (22,24) defining a draw-in gap (26) arranged at the inlet opening (20) for drawing in bank notes and rotatable about axes parallel to one another. characterized in that the container (10) includes a plurality of compartments (I to V, 48) for receiving bank notes, that the receiving openings of the compartments (I to V, 48) are selectively connectable with the draw-in gap (26), that one (48) of said compartments is formed by a portion of the housing (12) and that the remaining compartments (I to V) are formed by compartment walls (38) separated from one another in a frame (32), which frame is supported in the housing (12) for pivotal movement about a pivot axis (28) parallel to said axes of said draw-in rollers (22, 24), and that the receiving openings of the compartments (I to V) can be brought sequentially into alignment with the draw-in gap (26) by pivotal movement of the frame (32).

2. A container according to claim 1 further characterized in that tongues (106) are formed on the edge portion of each compartment wall (38) facing the draw-in gap (26) which tongues are receivable in complementary circumferential grooves (108) on at least one of the draw-in rolls (22,24).

3. A container according to claim 2 further characterized in that on the edge portion of each compartment wall (38) between the tongues (106) are open areas (110) the edges of which are inclined to the direction of the draw-in gap (26).

4. A container according to claim 1, further characterized in that the pivotal frame (32) is provided on an outer side with a deflector (44) which in an end position of the frame (32) conducts the pulled in bank notes from the draw-in gap (26) directly to said compartment (48) formed by a portion of the housing (12).

5. A container according to claim 1 further characterized in that the frame (32) is adjustable by means of a drive motor (50) against the force of a spring.

6. A container according to claim 1 further characterized in that sensing elements (70,72) are provided for determining the monetary position of the frame (32).

7. A container according to claim 1 further characterized in that at least some of the compartment walls (38) are each supported for pivotal movement relative to the frame (32) about axes (40,42) parallel to the pivot axis (28) of the frame (32).

8. A container according to claim 1 further characterized in that the housing (12) has an opening (14) closable by a cover (16) and that the frame (32) is pivotal to a removable position in which the receiving openings of said remaining compartments (I to V) are accessible through the opening (14) of the housing (12).

9. A container according to claim 8 further characterized in that a slide (82) is supported on the frame (32) for shifting movement generally toward and away from said frame pivot axis (28) and which slide has at least one arm (84) positioned generally perpendicularly to said compartment walls (38) and passing through slots (85) in the compartment walls (38), said slide arm (84) serving to support the bank notes deposited in said remaining compartments (I to V), and said slide being movable relative to said frame between a first position at which said arm (84) is located near said frame pivot axis (28) and a second position at which said arm (84) is located farther from said frame pivot axis (28).

* * * * *